US005302015A

United States Patent [19]

Du Vall

[11] Patent Number: 5,302,015

[45] Date of Patent: Apr. 12, 1994

[54] ADJUSTABLE KEYBOARD DRAWER

[75] Inventor: Gregory Du Vall, Santa Monica, Calif.

[73] Assignee: Microcomputer Accessories, Inc., Los Angeles, Calif.

[21] Appl. No.: 849,893

[22] Filed: Mar. 12, 1992

[51] Int. Cl.[5] ..... A47B 88/00; E04G 3/00; A47H 1/00

[52] U.S. Cl. ..... 312/282; 312/323; 248/286

[58] Field of Search ..... 312/334.4, 334.8, 334.14, 312/280–282, 233.3, 233.2, 331, 323; 211/43–42, 117; 248/286, 918; 108/143, 138, 72, 73

[56] References Cited

U.S. PATENT DOCUMENTS

| | | | |
|---|---|---|---|
| 851,659 | 4/1907 | Gaaikema . | |
| 886,192 | 4/1908 | De Canio | 312/334.14 X |
| 1,037,627 | 9/1912 | Hunter . | |
| 1,122,372 | 12/1914 | Duncan . | |
| 2,451,259 | 10/1948 | Tronic | 108/138 |
| 2,524,386 | 10/1950 | Johnston . | |
| 2,710,783 | 6/1955 | Chaft . | |
| 2,739,864 | 3/1956 | Saunders | 312/334.4 X |
| 2,822,229 | 2/1958 | Carlson . | |
| 3,113,818 | 12/1963 | Armentrout et al. | 312/334.4 X |
| 3,172,551 | 3/1965 | Wolfe . | |
| 3,866,866 | 2/1975 | Kneile | 312/323 |
| 3,902,034 | 8/1975 | Isozaki . | |
| 4,068,908 | 1/1978 | Horn | 312/208.1 X |
| 4,194,452 | 3/1980 | Crowther et al. | 108/138 |
| 4,316,082 | 2/1982 | Fritz . | |
| 4,496,200 | 1/1985 | Hagstrom et al. | 312/223.3 |
| 4,550,666 | 11/1985 | Svoboda . | |
| 4,616,798 | 10/1986 | Smeenge et al. . | |
| 4,625,657 | 12/1986 | Little et al. . | |
| 4,632,349 | 12/1986 | Anstey . | |
| 4,636,893 | 1/1987 | Nelson . | |
| 4,688,862 | 8/1987 | Fowler et al. | 312/223.3 X |
| 4,691,188 | 9/1987 | Cotterill | 248/284 |
| 4,691,888 | 9/1987 | Cotterill | 248/918 X |
| 4,776,284 | 10/1988 | McIntosh . | |
| 4,893,885 | 1/1990 | Boreillo | 312/282 X |

OTHER PUBLICATIONS

MicroComputer Accessories, Inc., UFO, 1992 Product Catalog, Sep. 1991 pp. 18–20.

*Primary Examiner*—Kenneth J. Dorner
*Assistant Examiner*—Nancy Mulcare
*Attorney, Agent, or Firm*—Price, Gess & Ubell

[57] ABSTRACT

A keyboard support having an adjustable keyboard shelf is provided. The keyboard support includes a base having a pair of upper and lower horizontal slots. A pair of bars connect the keyboard shelf to the slots. Inner ends of the bars slide within the slots to allow the shelf to be withdrawn from, or retracted into, the base. One of the slots includes an angled end portion allowing the bars to pivot with respect to the slots. As a consequence of the pivot action, the keyboard shelf is selectively raised or lowered. A rack and pinion mechanism is provided within the slots to limit jamming of the shelf as it is withdrawn from, or retracted into, the base. The invention provides a sturdy adjustable keyboard support inexpensively constructed of few moving parts.

20 Claims, 7 Drawing Sheets 18
34
36
37
38
39
41
42
43
44
45
46
47
49
50
52
54
56
58
60
62
64
66
66₁
66₂
66₃
70

310
312
314
318
338
339
341
343
348
352
354
356
358
360
361
362
363
364
366
370
336
9

ADJUSTABLE KEYBOARD DRAWER

BACKGROUND OF THE INVENTION

1. Field of the Invention

The invention relates generally to keyboard support shelves and, in particular, to a keyboard support shelf having means for adjusting the height of the keyboard.

2. Description of Related Art

A wide variety of keyboard supports are known in the prior art. A conventional keyboard support provides a shelf for supporting a keyboard with the shelf mechanically connected to a base mounted either above or below a desk-top. Typically, the shelf is extendable from the base when in use and retractable into the base when not in use. In many such devices, the height, inclination or tilt of the keyboard may be adjusted while extended.

Typically, means for extending and retracting the keyboard and for raising, lowering, and tilting the keyboard are elaborate, include numerous moving parts and, consequently, are expensive to manufacture. Such complicated keyboard supports are easily broken and difficult to repair. Often, the keyboard support is spring loaded to the base to bias the keyboard shelf toward one position or another. Spring-loaded mechanisms tend to lose their effectiveness with time.

Further, elaborate keyboard support mechanisms, particularly spring-loaded mechanisms, do not rigidly support a keyboard such that, in use, the keyboard jiggles.

Keyboard support structures having simple mechanisms often provide a sturdier shelf for the keyboard, yet do not provide adequate means for adjusting the height of the keyboard.

SUMMARY OF THE INVENTION

Accordingly, it is an object of the invention to provide an inexpensive, sturdy keyboard support having means for adjusting the height of the keyboard.

It is a further object of the invention to provide a keyboard support structure composed of few moving parts.

It is a further object of the invention to provide a keyboard support mountable to a desk-top having an extendable keyboard shelf which depends below the height of the desk-top when extended.

It is yet another object of the invention to provide a keyboard support mountable to the underside of a desk and having an extendable keyboard shelf which is positionable above or even with the desk-top when extended.

It is another object of the invention to provide a keyboard support with an extendable keyboard shelf having a simple mechanism for either raising or lowering the keyboard shelf.

It is another object of the invention to provide a keyboard support with an extendable keyboard shelf having means for avoiding buckling or jamming during extension and retraction.

These and other objects of the invention are achieved by the provision of an adjustable keyboard support having a shelf for supporting a keyboard with the shelf connected to a base by a support arm mechanism. The support arm mechanism includes upper and lower bars, respectively connecting upper and lower points on the shelf to upper and lower horizontal slots in the base. Inner ends of the bars are slidably and pivotally received in the respective slots. The outer ends of the bars are pivotally mounted to the shelf. The horizontal slots allow the shelf to be extended from, and retracted into, the base.

One of the slots includes an angled outside end portion. The angled portion is provided to allow the inner end of the corresponding bar to be vertically raised or lowered. A plate connects the inner end of one bar to an intermediate pivot point on the other bar, thus leaving an inner end free to pivot up or down within the angled end portion. The configuration ensures that the two bars remain parallel to each other. Thus, both bars pivot equally as the free end is raised or lowered within the angled portion. The pivoting of the bars causes the shelf to be raised or lowered. In this manner, the vertical height of the keyboard shelf is variable.

Preferably, two of such support arms are provided, one on the left and one on the right end of the keyboard shelf for mounting to left and right support walls of the base. The plate is generally triangular and includes a pair of rollers for rolling within the slot without the angled end portion, such that the keyboard shelf is easily and smoothly extended from, and retracted into, the base. The angled end portion preferably includes detents for receiving and holding the inner end of the free bar, to thereby secure the shelf in a vertically displaced position.

Also in accordance with the preferred embodiment, one of the slots includes an inner recessed slot. The inner recessed slot has a toothed rack formed along an edge. A pinion connects the recessed slot of the left support surface of the base to the recessed slot of the right support surface of the base. The pinion includes gears for engaging the racks of the opposing inner recessed slots such that, during extension or retraction of the keyboard shelf, buckling and jamming is avoided.

In accordance with one embodiment, the upper slot is provided with the angled end portion, to allow the keyboard shelf to be lowered when fully extended from the base. In accordance with a second embodiment, the lower slot is provided with the angled end portion, to allow the keyboard shelf to be raised when fully extended from the base. Various other embodiments are also provided.

In any of its embodiments, the invention provides a sturdy keyboard support capable of raising or lowering a keyboard. The keyboard support is constructed of few moving parts to be reliably and inexpensively manufactured.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an adjustable keyboard support having a retractable and extendable keyboard shelf, with the shelf vertically positionable while extended.

Referring to the figures, various embodiments of the invention will now be described.

Figure 1:
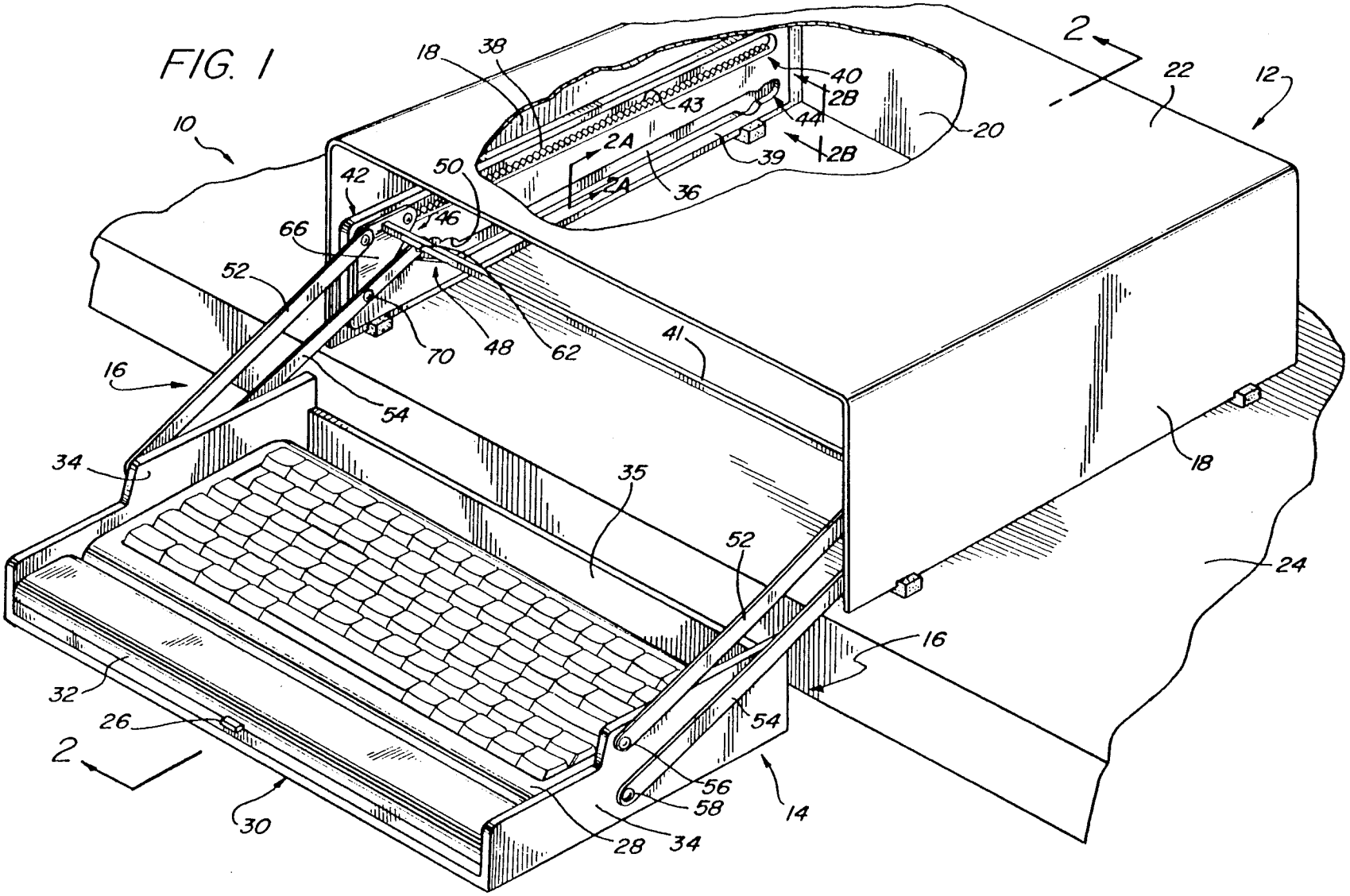
FIG. 1 is a perspective view of a desk-top embodiment of the invention showing a keyboard extended for use.

In FIG. 1, a desk-top embodiment of an adjustable keyboard support 10 is shown. Keyboard support 10 includes a base 12 and a keyboard shelf 14. First and second support arms 16 connect keyboard shelf 14 to base 12.

Base 12 includes left and right side supports 18, a rear side support 20, and a top 22. Base 12, which is preferably constructed of wood, pressed-board, metal, or durable plastic, rests on a desk-top surface 24.

Keyboard shelf 14 includes a flat upper surface for supporting a conventional computer keyboard 28. A forward edge of keyboard shelf 14 is provided with a tray 30 having a cushioned lid 32. Hinges (not shown) are provided to connect lid 32 to keyboard shelf 14. A tab 26 is provided to facilitate opening and closing the lid. Tray 30 is provided for storing pencils, pens, and the like for convenient access while using the keyboard. Cushioned lid 32 serves as a wrist rest. Lid 32 is preferably constructed to rest, when closed, at a height sufficient to comfortably support a user's wrists. Keyboard shelf 14 includes opposing side walls 34 and a rear wall 35. Side walls 34, rear wall 35, and tray 30 serve to secure keyboard 28 on shelf 14.

Although not shown, a computer and a CRT are preferably positioned atop base 12. Base 12 serves both as a platform for supporting the computer at a convenient height, and as a drawer for storing keyboard 28 and keyboard shelf 14, as discussed below. An opening (not shown) may be provided within rear wall 35 to allow a cord of the keyboard to be conveniently connected to the computer.

Opposing side walls 18 of base 12 are each provided with lower and upper inner horizontal slots or tracks 36 and 38, respectively. If base 12 is constructed of a sufficiently thick material, slots 36 and 38 are preferably formed as recessed slots within opposing surfaces 18. Alternatively, if base 12 is constructed of a thin material, slots 36 and 38 are formed within a plate 39 mounted to side surfaces 18.

Upper horizontal slot 38 extends substantially along the entire length of side surface 18 from an inner end 40 to an outer end 42. Lower slot 36 extends a lesser distance from an inner end 44 to an outer point 46. Preferably, inner ends 40 and 44 are aligned, whereas outer end 42 extends several inches beyond outer end 46. Lower slot 36 includes an upwardly-angled end portion 48. Angled end portion 48 extends upwardly at a 20- to 40-degree angle and includes a set of notches or detents 50 formed along an upper inner edge thereof. Angled end portion 48, as discussed below, is provided to allow the height of keyboard shelf 14 to be vertically adjusted.

Each arm 16 includes upper and lower mounting bars 52 and 54, respectively. Outer ends of bars 52 and 54 are pivotally connected to keyboard shelf side surface 34 at pivot points 56 and 58, respectively. Preferably, pivot point 56 is positioned directly above pivot point 58. Mounting bars 52 and 54 are flat and are held closely adjacent to side surfaces 34. In this manner, side surfaces 34 prevent bars 52 and 54 from flexing left or right. Hence, keyboard shelf 14 remains in proper alignment with base 12.

Figures 2, 2A, 2B:
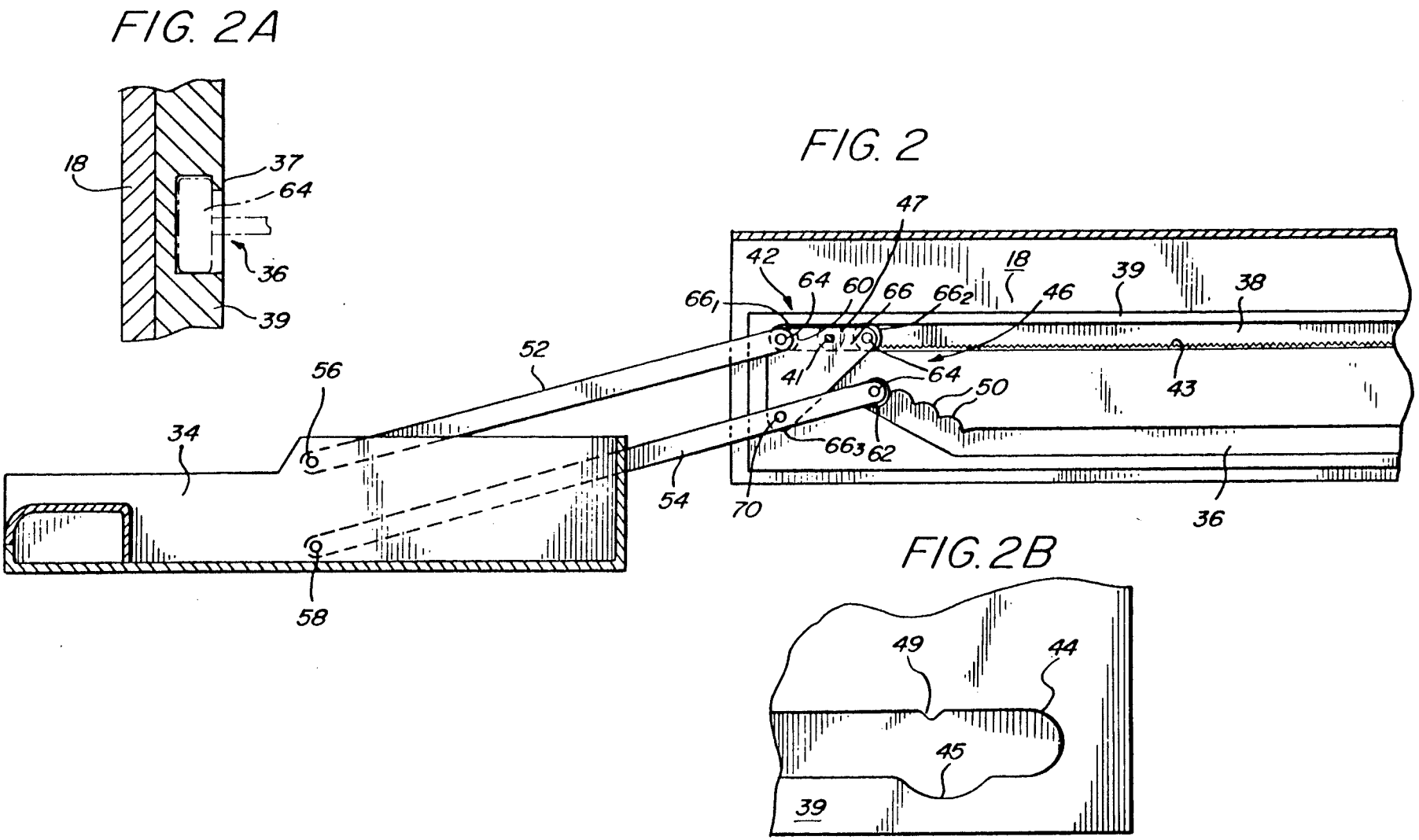
FIG. 2 is a side cross-sectional view of the embodiment of FIG. 1 taken along line 2—2.
FIG. 2A is a cross-sectional view of a portion of the embodiment of FIG. 1 taken along line 2A—2A.
FIG. 2B is a side elevational view of a portion of the embodiment of FIG. 1 taken along line 2B—2B.

As shown most clearly in FIG. 2, mounting bars 52 and 54 also include inner ends 60 and 62 slidably received within upper and lower slots 38 and 36, respectively. Inner ends 60 and 62 are each provided with a roller, generally denoted 64. The provision of rollers 64 allows the inner ends of the mounting bars to be smoothly displaced within the horizontal slots. The outer diameter of rollers 64 is preferably slightly smaller than the inner width of the slots to facilitate smooth rolling.

As shown in FIG. 2A, lower slot 36 includes a downward-extending lip 37 provided to keep rollers 64 (shown in phantom lines) within the slot. Lip 37 extends along substantially the entire length of slot 36 to secure roller 64 within the slot at any point along the slot. However, a small portion (not shown) of slot 36 may be provided without lip 37 to facilitate the initial mounting of roller 64 into the slot during manufacture. Upper slot 38 also preferably includes a similar, although upwardly-extending, lip.

Each connecting arm 16 includes a generally triangular mounting plate 66 having vertices $66_1$, $66_2$, and $66_3$. Inner end 60 of upper mounting bar 52 is affixed to an outer vertex $66_1$. Inner vertex $66_2$ includes a separate roller 64, also received within upper slot 38.

Lower vertex point $66_3$ is connected to lower mounting bar 54 at a pivot point 70 intermediate the inner and outer ends thereof.

Thus, upper mounting bar 52 is pivotally connected at its outer end to keyboard shelf 14 and at its inner end to mounting plate 66. Lower mounting bar 54 is pivotally connected at its outer end to keyboard shelf 14. However, the inner end of lower mounting bar 54 is not connected to mounting plate 66, but rather is free to pivot about intermediate point 70. In this manner, mounting bars 52 and 54 remain parallel, yet can pivot at an angle from the horizontal. Inner end 62 of lower bar 54 is hereinafter also called free end 62.

The combination of angled end portion 48 of lower slot 36 and the pivoting ability of lower mounting bar 54 allows keyboard shelf 14 to be vertically lowered to the height shown in FIGS. 1 and 2.

In use, keyboard shelf 14 is extended, as shown in FIGS. 1 and 2, with inner end 60 of upper mounting bar 52 positioned at outer end 42 of upper slot 38, and with inner end 62 of lower mounting bar 54 positioned in one of the detents 50. The vertical position of keyboard shelf 14 may be varied by repositioning inner end 62 within one of the other detents 50. The higher the detent, the lower the keyboard. The embodiment shown in FIGS. 1 and 2 includes four such detents, such that keyboard shelf 14 is positionable at four discrete vertical heights, each height lower than the retracted height of the keyboard. In this manner, although base 12 is mounted to a desk-top, keyboard 28 is conveniently positionable at a height below the desk-top.

For storage, keyboard shelf 14 is retracted within base 12. Retraction is accomplished by pressing inwardly along forward edge 30 of keyboard support 14 such that rollers 64 roll within slots 36 and 38. As keyboard shelf 14 is pushed inwardly, inner end 62 advances along angled portion 48 past detents 50, thus lowering free end 62 and pivotally raising shelf 14. Keyboard shelf 14 rises incrementally until inner end 62 enters the horizontal portion of slot 38. Thereafter, keyboard shelf 14 remains at a constant height. Keyboard shelf 14 is pressed further inwardly until vertex point $66_2$ of mounting plate 66 rests near inner end 40 of upper slot 38 and inner end 62 of lower mounting bar 54 near inner end 54 of lower slot 36. The retracted configuration is shown in FIGS. 5, 7, 10, and 12, each showing similar, but alternative, embodiments of keyboard support 10.

Referring to FIG. 2B, the upper edge of lower slot 36 includes a slight downward-facing notch 49. A detent 45 is formed along the lower edge of the slot under notch 49.

Notch 49 is provided to secure shelf 14 in a retracted configuration. As roller 62 (not shown in FIG. 2B) of lower bar 54 is retracted to inner end 44 of lower slot 36, the roller is deflected downwardly under notch 49. Detent 45 ensures that the roller has sufficient clearance to traverse notch 49. Once positioned on the inward side of notch 49, the roller is prevented by the notch from accidently rolling outwardly. In this manner, the keyboard shelf is secured in the retracted configuration. To extend the keyboard, one merely pulls outwardly on the keyboard with sufficient force for the roller to overcome notch 49.

Teeth 43 are provided on a lower inner surface of upper slot 38. A square axle 41 having opposing pinions 47 operates in conjunction with teeth 43 to prevent jamming of mounting plate 66 as it traverses lower and upper slots 36 and 38. The pinions are fixed to opposing ends of the axle such that the pinions rotate simultaneously. Thus, a pair of opposing rack and pinion mechanisms are provided. As seen most clearly in FIG. 1, axle 41 connects opposing mounting plates 66. Opposing ends of axle 41 are provided with pinions 47, which include teeth for engaging the teeth of upper slot 38.

As keyboard shelf 14 is extended or retracted, pinions 47 engage teeth 43 to cause axle 41 to rotate. The provision of teeth 43 and pinions 47 prevents mounting plate 66 from jamming as keyboard shelf 14 is extended or retracted. Jamming is avoided, because teeth 43 ensure that opposing pinions 47 of axle 41 move laterally at equal rates. Without teeth 43 and pinions 47, one of the opposing mounting plates 66 may advance faster than the other, thus causing jamming. By maintaining proper lateral alignment of opposing mounting plates, the rollers reach the upwardly-angled portion of the slots simultaneously during extension of the keyboard. In this manner, the keyboard remains level.

Axle 41 further serves to maintain proper alignment of opposing plates 66 and helps to secure roller 64 within the respective slots. In this manner, neither opposing plate 66 is allowed to move along the axial direction of axle 41.

The inner recesses of the teeth of the pinions define an inner diameter for the pinions. The diameter of the rollers is preferably equal to the inner diameter of the pinions, such that the rollers roll on top of the teeth of the slot, even with the pinions.

Thus the combination of slots 36 and 38 and roller-mounted bars 52 and 54 allow a keyboard to be smoothly extended from, and retracted into, base 12. The combination of angled end portion 46 and connecting plate 66 allows bars 52 and 54 to pivot, thereby raising or lowering the keyboard. Thus easy vertical height adjustability is achieved with few moving parts and without the need for spring-biasing. Further, no clumsy switches or levers need be manipulated to adjust the height of the keyboard. Axle 41 with opposing pinions 47 engaging teeth 43 ensure that the shelf can be extended and retracted without jamming.

Figure 3:
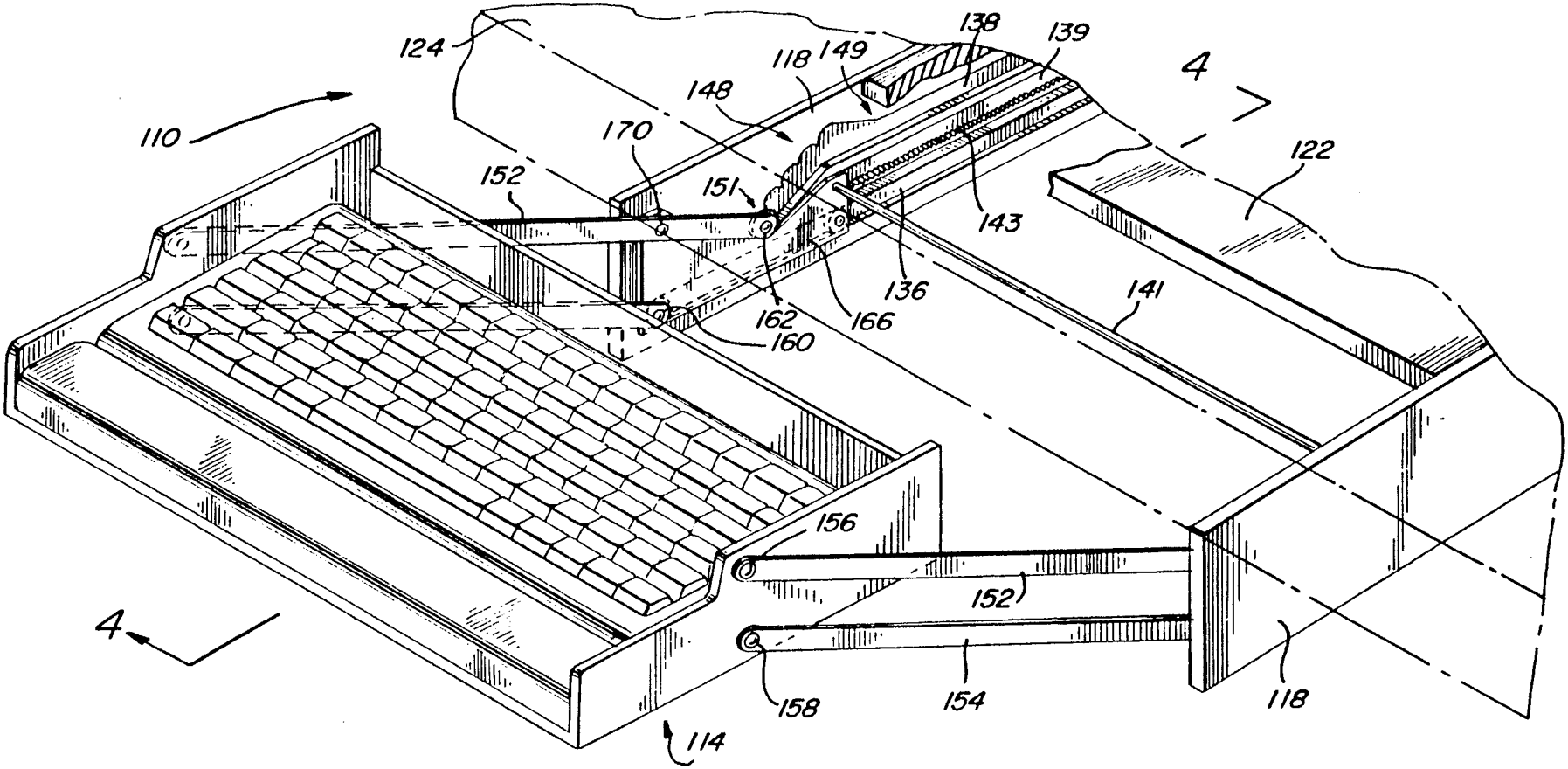
FIG. 3 is a perspective view of an under-desk embodiment of the invention showing a keyboard extended for use.
Figure 4:
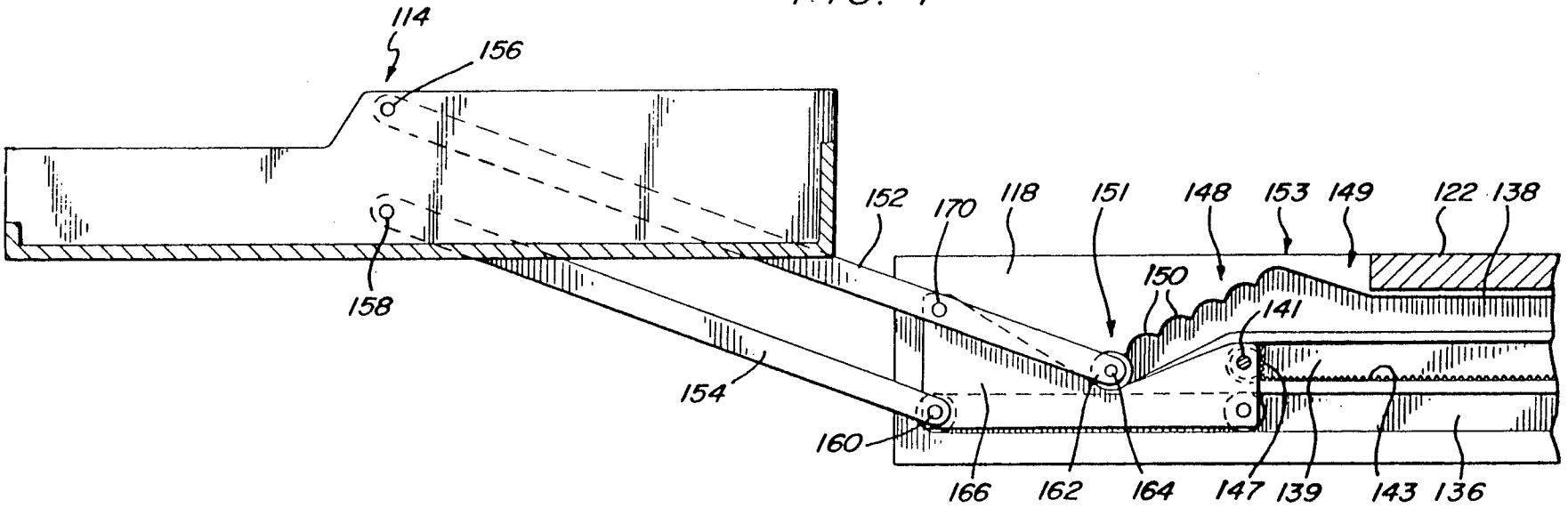
FIG. 4 is a partial cross-sectional view of the embodiment of FIG. 3 taken along line 4—4, showing a keyboard extended for use.
Figure 5:
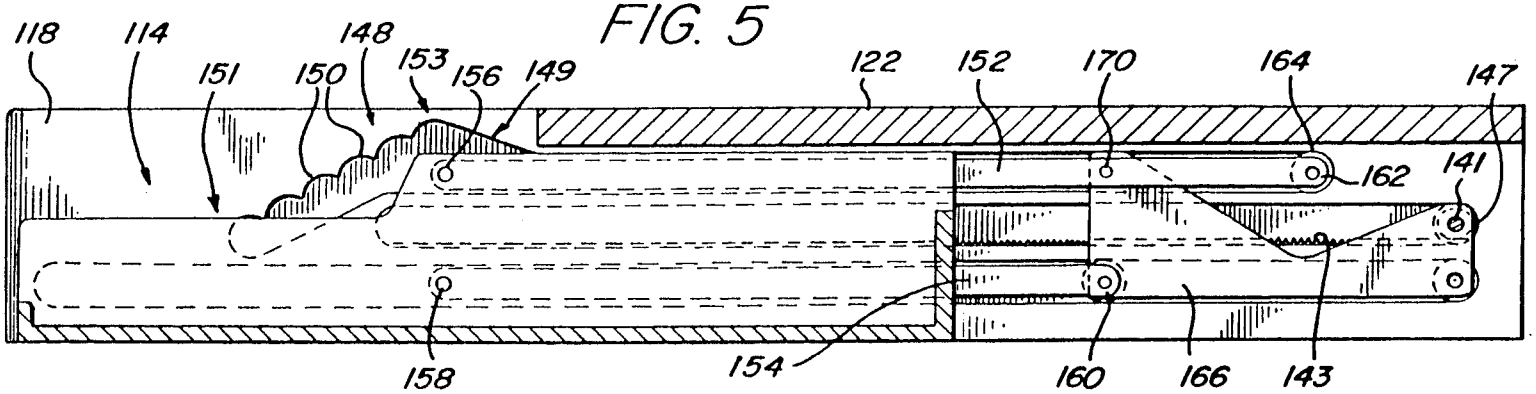
FIG. 5 is a cross-sectional view of the embodiment of FIG. 3 showing a keyboard retracted for storage.

Referring to FIGS. 3, 4, and 5, a first alternative embodiment is shown. The embodiment of FIGS. 3, 4, and 5 is substantially similar to that of FIGS. 1 and 2, and only relevant differences will be described.

In FIG. 3 an under-desk keyboard support 110 is shown in perspective.

FIG. 4 provides a cross-sectional view of the under-desk keyboard support of FIG. 3. In FIG. 4, keyboard support 110 is shown in a fully extended position.

In FIG. 5, keyboard support 110 is shown in a fully retracted position.

As shown in FIG. 3, a top surface 122 of keyboard support 110 mounts to the under side of a desk-top 124. Mounting is accomplished by conventional means (not shown) such as screws or bolts.

A total of three generally horizontal slots are provided within opposing walls 118, including an upper slot 138, a lower slot 136, and a central slot 139. Upper slot 136 includes an angled end portion 148 which angles first upwardly, then downwardly. The upwardly-angled portion is denoted 149, and the downwardly-angled portion is denoted 151. The provision of upwardly- and downwardly-angled portions of slot 136 allows a keyboard shelf 114 to be selectively raised or lowered.

Lower slot 136 is completely horizontal and extends substantially along the entire length of a side surface 118 of support 110.

As with the embodiment of FIGS. 1 and 2, upper and lower mounting bars are provided. In FIGS. 3, 4, and 5, the upper and lower mounting bars are denoted 152 and 154, respectively. Lower mounting bar 154 is pivotally connected to keyboard shelf 114 at pivot point 158 and is pivotally connected to a mounting plate 166 at pivot point 160. Thus lower mounting bar 154 of the embodiment of FIGS. 3, 4, and 5 corresponds to the upper mounting bar 52 of the embodiment of FIGS. 1 and 2.

Upper mounting bar 152 is pivotally connected to keyboard shelf 114 at pivot point 156. Inner end 162 of upper mounting bar 152 is slidably and pivotally received within upper slot 138. An intermediate point 170 of upper mounting bar 152 is pivotally mounted to an upper outer vertex point of mounting plate 166. Thus, upper mounting bar 152 of the embodiment of FIGS. 3, 4, and 5 corresponds to lower mounting bar 54 of the embodiment of FIGS. 1 and 2.

An upper wall 122 connects left and right supports 18, each of which has corresponding upper, lower, and central slots.

In most respects the embodiment of FIGS. 3, 4, and 5 is identical to the embodiment of FIGS. 1 and 2, with the upper and lower slots and upper and lower mounting bars reversed such that keyboard shelf 114 is raised rather than lowered when fully extended.

However, the embodiment of FIGS. 3, 4, and 5 includes two additional differences, namely, the provision of upwardly-angled portion 149 of upper slot 138, and the provision of central slot 139 provided between lower and upper slots 136 and 138.

Considering first the effect of the upwardly-angled portion 149, as keyboard shelf 114 is moved from a fully retracted position, shown in FIG. 5, to the fully extended position shown in FIGS. 3 and 4, an inner free end 162 of upper mounting bar 152 traverses the horizontal portion of upper slot 136, during which keyboard shelf 114 maintains a constant height. However, once free end 162 reaches upwardly-angled portion 149, free end 162 rises and keyboard shelf 114 is correspondingly lowered as a result of the pivot action of the upper and lower bars described above with reference to the embodiment of FIGS. 1 and 2. Keyboard shelf 114 continues to descend as free end 162 rises within the upwardly-angled portion 149. The intermediate position wherein free end 162 traverses upwardly-angled portion 149 is not shown in the figures.

A detent 150 is provided at an apex 153 between upwardly-angled portion 149 and downwardly-angled portion 151 to receive free end 162, thereby securing keyboard shelf 114 in a lowered position. If, however, free end 162 is not secured within apex 153 and continues to be moved forward, free end 162 reaches downwardly-angled portion 151. As free end 162 traverses downwardly-angled portion 151, keyboard shelf 114 is incrementally raised. A set of detents 150 is provided along an upper edge of downwardly-angled portion 148 such that free end 162 can be secured at various points. In this manner, keyboard shelf 114 is positionable in various raised positions. In the embodiment of FIGS. 3, 4, and 5, a total of six detents is provided. Additional detents may be provided along upwardly-angled portion 149.

Thus, the provision of upwardly- and downwardly-angled portions of upper slot 138 allows keyboard shelf 114 to be positioned at various selected heights, either above or below the retracted height of the keyboard.

Central slot 139 is provided in conjunction with an axle 141 to prevent jamming of mounting plate 166 as it traverses lower and upper slots 136 and 138. Axle 141 is similar to axle 41 of FIGS. 1 and 2, but is shown as being round rather than square. Central slot 139 is provided with a rack of teeth 143 along a lower edge thereof. Axle 141 connects opposing mounting plates 166, shown most clearly in FIG. 3. Opposing ends of axle 141 are provided with pinions, which include teeth for engaging the teeth of central slot 139.

As keyboard shelf 114 is extended or retracted, pinions 147 engage teeth 143 to cause axle 141 to rotate. The provision of teeth 143 and axle 141 prevents mounting plate 166 from jamming as keyboard shelf 114 is extended or retracted. Jamming is avoided, because teeth 143 ensure that opposing pinions 47 of axle 41 move laterally at equal rates. Thus, the embodiment of FIG. 3 operates in much the same manner as the embodiment of FIGS. 1 and 2 to prevent jamming, to help secure the rollers within the slots, and to keep the shelf level as it is extended.

As with upper and lower slots 136 and 138, central slot 139 is preferably recessed within side wall 118. Alternatively, however, central slot 139 can be formed as a track mounted to side wall 118 (not shown).

Figure 6:
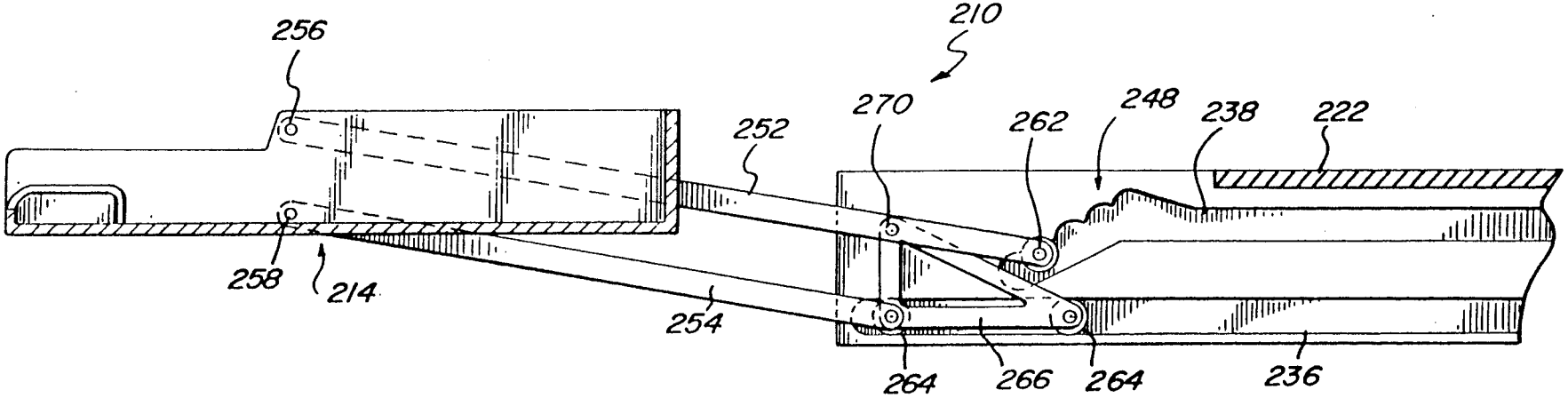
FIG. 6 is a partial cross-sectional view of an alternative under-desk embodiment of the invention showing a keyboard extended for use.
Figure 7:
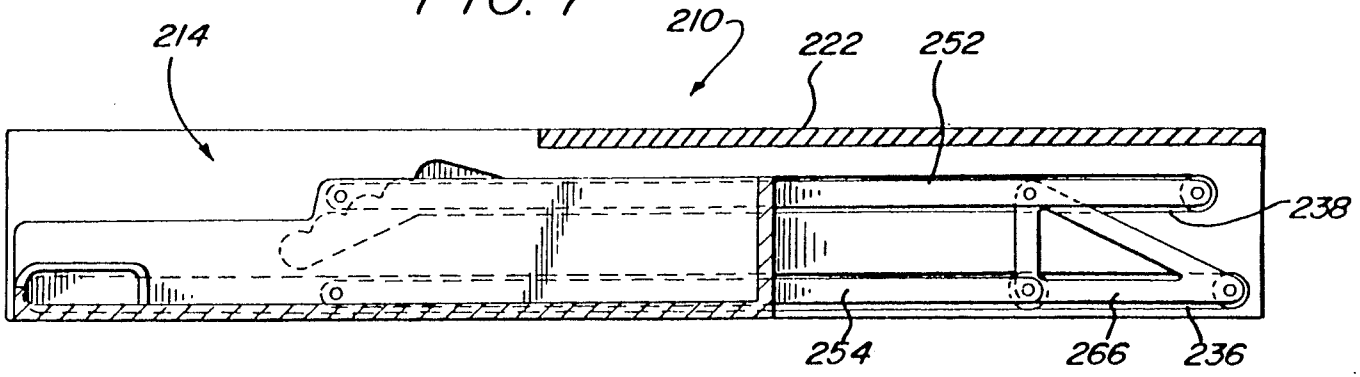
FIG. 7 is a cross-sectional view of the embodiment of FIG. 6 showing a keyboard retracted for storage.

Referring to FIGS. 6 and 7, an alternative embodiment of the keyboard support of FIGS. 3, 4, and 5 is shown. Keyboard support shelf 210 of FIGS. 5, 6, and 7 is similar to keyboard support shelf 110 of FIGS. 3, 4, and 5, with the exception that no central groove and no rack and pinion mechanism is provided. In FIG. 6, a keyboard shelf 214 is shown in a fully extended position, with keyboard shelf 214 vertically raised.

FIG. 7 provides a side elevational view of the embodiment of FIGS. 3, 4, and 5, showing keyboard shelf 214 in a fully retracted position.

Keyboard support 210 includes upper and lower mounting bars 252 and 254. Upper bar 252 connects pivot point 256 on keyboard shelf 214 to an upper slot 238. Lower bar 254 connects a lower pivot point 258 to a connecting plate 266. Connecting plate 266 includes two rollers 264 received within a lower horizontal slot 236. Upper bar 252 is mounted to plate 266 at a pivot point 270 such that an inner end 262 pivots freely within an angled end portion 248 of upper slot 238.

An upper wall 222 connects left and right side supports, each of which has corresponding upper and lower slots.

The embodiment of FIGS. 6 and 7 operates similarly to the embodiment of FIGS. 3, 4, and 5. However, since no central groove is provided, mounting plate 266 requires only a simple triangular shape, as shown. Mounting plate 266 includes a central triangular aperture provided to minimize the weight and cost of the mounting plate.

Figures 8, 9, 10:
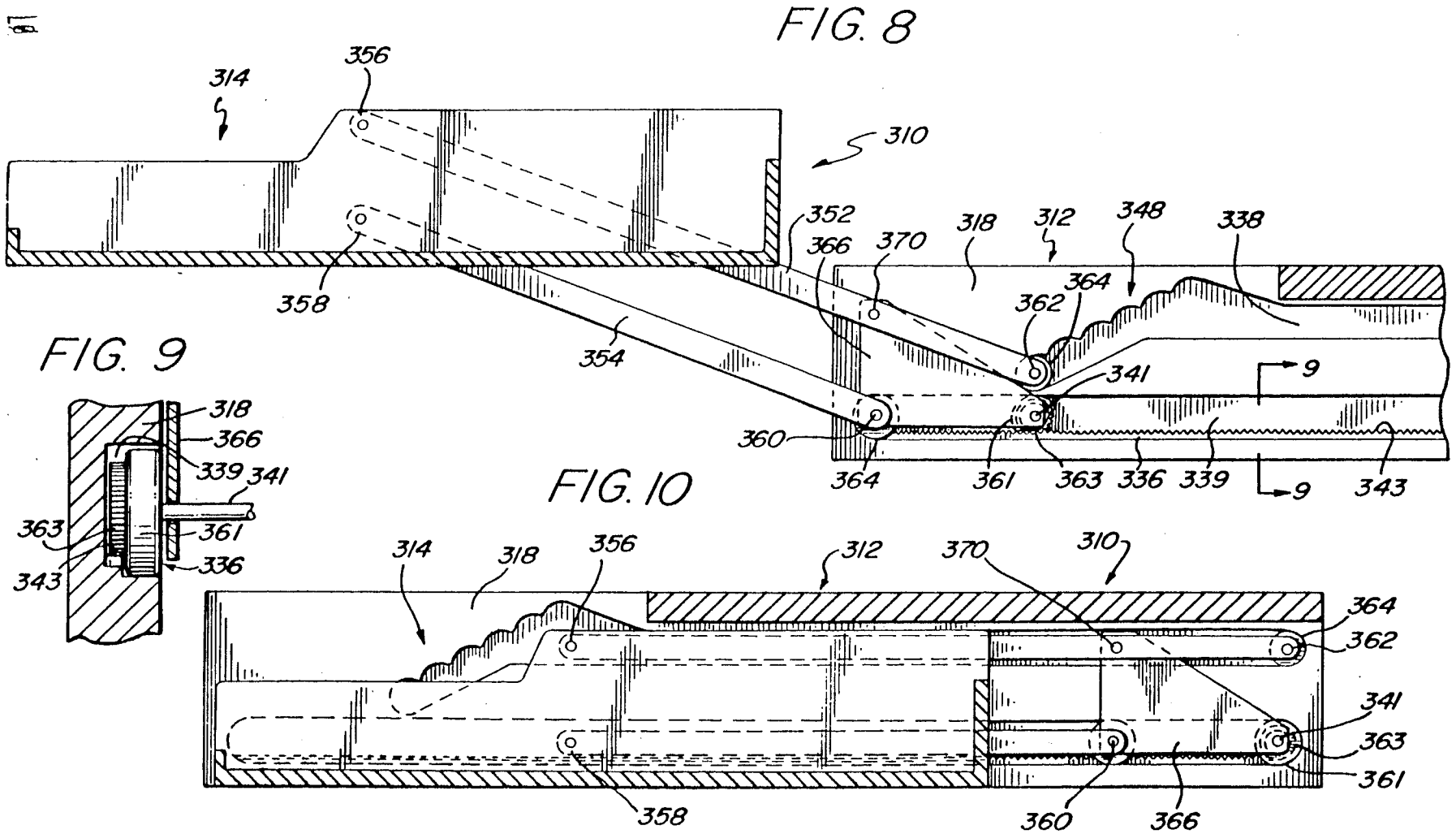
FIG. 8 is a partial cross-sectional view of a second alternative under-desk embodiment of the invention showing a keyboard extended for use.
FIG. 9 is a partial cross-sectional view of the embodiment of FIG. 8 taken along line 9—9.
FIG. 10 is a cross-sectional view of the embodiment of FIG. 8 showing a keyboard retracted for storage.

FIGS. 8, 9, and 10 provide another alternative embodiment of the invention. A keyboard support 310 is shown having a keyboard shelf 314 and a base 312. Upper and lower connecting bars 352 and 354 respectively connect pivot points 356 and 358 to upper and lower slots 338 and 336. An inner end 360 of lower bar 354 includes a roller 364 for rolling within lower slot 336. An intermediate point 370 of upper bar 352 is connected to a mounting plate 366. An inner end 362 of upper bar 352 remains free to pivot within an angled end portion 348 of upper slot 338. Thus, the embodiment of FIGS. 8 and 9 is similar to that of FIGS. 3, 4, and 5, with the exception that the central slot is formed within the lower slot shown most clearly in FIG. 9. More specifically, an inner recessed slot 339 is provided within lower slot 336. Mounting plate 366 includes rollers 364 and 361, which traverse an outer portion of lower slot 336. A pinion 363 is provided coaxial with roller 361. Pinion 363 engages with teeth 343 formed along inner recessed slot 339. An axle 341 connects pinions 363 of opposing mounting plates 366.

As with the embodiment of FIGS. 3, 4, and 5, the provision of engaging teeth and pinions prevents jamming as the keyboard is extended or retracted.

FIG. 10 provides a side elevational view of the embodiment of FIG. 8, showing the keyboard in a fully retracted position.

Figure 11:
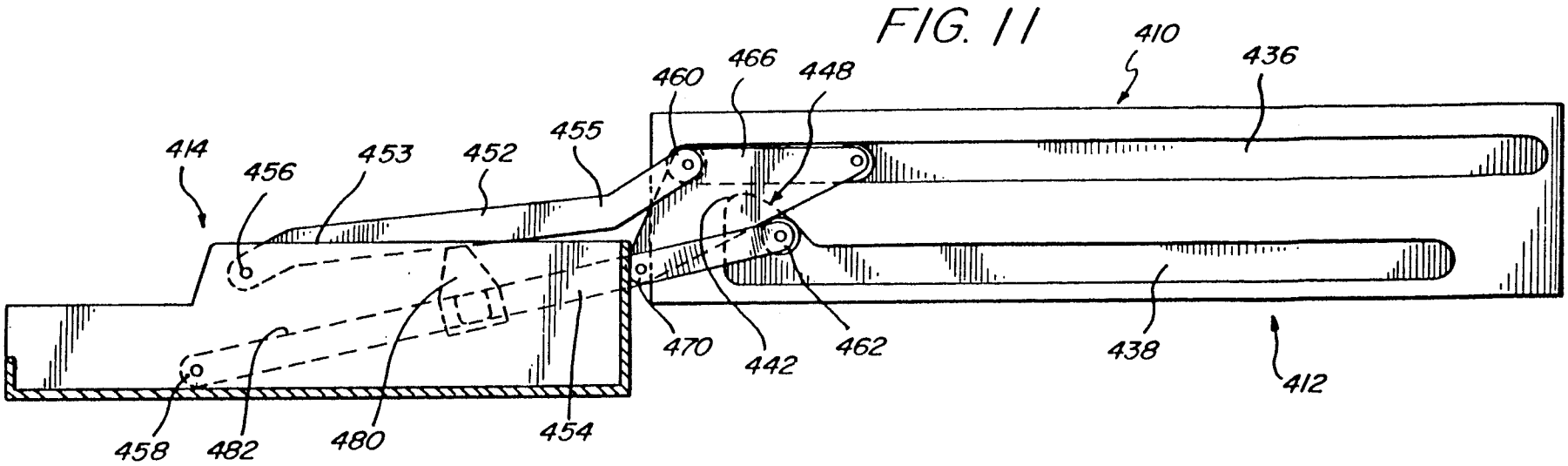
FIG. 11 is a cross-sectional view of an alternative embodiment of a desk-top keyboard support showing a keyboard shelf extended for use.
Figure 12:
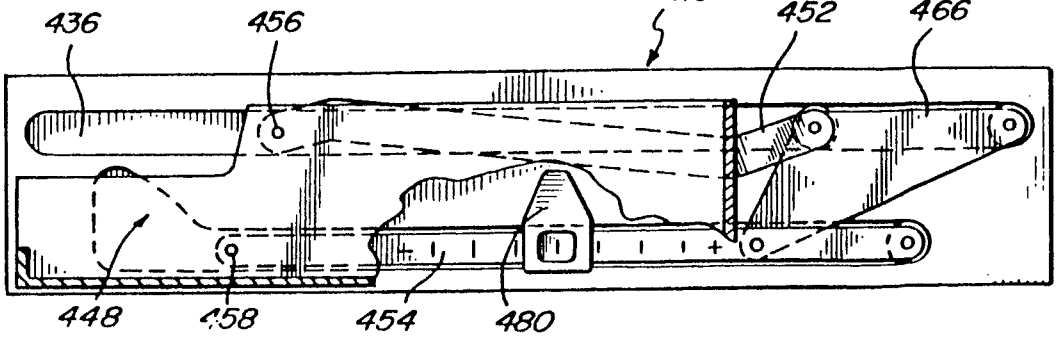
FIG. 12 is a cross-sectional view of the embodiment of FIG. 11 showing a keyboard retracted for storage.

Another alternative embodiment of the invention is shown within FIGS. 11 and 12. A keyboard support 410 is provided with a keyboard shelf 414 and a base 412. Upper and lower connecting bars 452 and 454 respectively connect upper and lower pivot points 456 and 458 to upper and lower slots 436 and 438. Lower connecting bar 454 is mounted to a connecting plate 466 at an intermediate point 470, allowing an inner end 462 to pivot freely within an angled end portion 448 of lower slot 438. Rollers are provided for mounting plate 466 and inner free end 462 to the slots.

Thus, the embodiment of FIGS. 11 and 12 is similar to previous embodiments, with the exception that no detents are formed along the angled portion of the lower slot. Rather, a slidable tab 480 is provided along an upper edge 482 of lower mounting bar 454 for securing free end 462 at a point along the angled portion. Tab 480 is manually positionable at various points along upper edge 482 of lower mounting bar 454.

Mounting plate 466 is configured somewhat differently than the previously-described embodiments. Rather than being generally shaped as a right-angle triangle, mounting plate 466 is shaped more in the form of a scalene triangle, as shown. Additionally, upper and lower mounting bars 452 and 454 are not parallel, as with the embodiments previously described. Rather, upper bar 452 is slightly S-shaped. Accordingly, upper and lower mounting bars 452 and 454 are angled with respect to each other.

FIG. 12 provides a side elevational view of the embodiment of FIG. 11, showing the keyboard fully retracted.

As shelf 414 is withdrawn from the retracted configuration of FIG. 12, free end 462 of lower mounting bar 454 traverses upwardly-angled portion of lower slot 438, keyboard shelf 414 is lowered until upper mounting bar 452 rests against tab 480. The provision of tab 480 eliminates the need for detents formed along the angled portion of lower slot 438. Rather, the vertical height of keyboard shelf 414 is variable by sliding tab 480 along upper edge 482 of mounting bar 454. As tab 480 traverses mounting bar 454, the angle between the upper and lower mounting bars is continuously varied, rather than discretely varied as with the detents of the previously-described embodiments. Thereby, free end 470 pivots about mounting plate 456 at varying angles. As a consequence of the pivoting action of lower mounting bar 454, keyboard shelf 414 is raised or lowered.

More specifically, upper bar 452 tends to pivot about inner connection point 460, while lower connecting bar 454 tends to pivot about intermediate connection point 470. Without tab 480, both connecting bars would pivot downwardly until free end 462 of lower bar 454 reached upper corner 442 of angled end portion 448. However, tab 480 prevents unhindered pivoting. Upper bar 452 abuts tab 480 at a point determined by the lateral location of tab 480 on lower connecting bar 454. With upper bar 452 resting against tab 480, lower bar 454 is no longer free to pivot about intermediate point 470.

Keyboard shelf 414 is thereby secured at a particular height. By sliding tab 480 outwardly along lower bar 454, keyboard 414 is incrementally lowered. Additional lowering occurs because of the S-shape of upper bar 452. As a consequence of the S-shape, a forward portion 453 of upper bar 452 is farther from lower bar 454 than a rear portion 455. The differing spacing between the upper and lower connecting bars allows keyboard shelf 414 to pivot to a greater or lesser extent, depending upon the lateral location of tab 480. Thus, the lateral position of tab 480 sets the height of keyboard shelf 414, and no detents are required within angled end portion 448 of lower slot 438.

What has been described is a set of embodiments of a keyboard support having a keyboard shelf and a base, wherein the shelf is extendable from, and retractable into, the base. In the extended configuration, the vertical height of the keyboard shelf is selectable. The keyboard shelf is connected by a pair of bars to a pair of generally horizontal slots formed in the base. Outer ends of the bars are pivotally connected to the shelf, and inner ends of the bars are slidably mounted within the slots. Extension and retraction are achieved by sliding the inner ends of the bars along the slots with respect to the base. An outer end of one of the slots has an angled end portion, allowing the corresponding bar to pivot vertically when the shelf is extended. A mounting plate connects the upper and lower bars in a manner to allow the bars to pivot while the inner free end is vertically displaced within the angled end portion.

The bars and the mounting plate are preferably constructed of a durable, sturdy material such as a metal. The base and the keyboard shelf may also be constructed of metal or may be constructed of a wood or sturdy plastic material. The keyboard support is thus inexpensively and reliably constructed of few moving parts.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An adjustable keyboard support for use with a desk top comprising:

a shelf for supporting a keyboard;

a base having an outer end and an inner end, the outer end of said base locatable at a front edge of the desk top, said base including a vertical support surface having first and second slots, the first slot being substantially horizontal along its entire length and the second slot having a horizontal portion and an outer angled end portion;

at least one support arm connecting the shelf to the vertical support surface of said base;

the support arm having first and second bars respectively connecting first and second points on the shelf to the first and second slots in the vertical support surface;

the first and second bars respectively having inner ends slidably and pivotally received in the first and second slots of the base and outer ends pivotally mounted to the first and second points on the shelf; and a mounting plate for connecting the inner end of the first bar to a pivot point on the second bar, the pivot point being intermediate the inner and outer ends of the second bar so that the inner end of the second bar extends beyond the pivot point to be received in the second slot;

whereby the first and second bars of the support arm may be slid laterally along the first and second slots relative to the front edge of the desk top so that the shelf may be laterally positioned as desired and, when the inner end of the second bar reaches the outer angled end portion of the second slot, the first and second bars of the support arm are pivoted so that the shelf may be vertically positioned as desired.

2. The adjustable keyboard support of claim 1, provided with two of the support arms and two of the vertical support surfaces, the support arms connecting opposing ends of the shelf to the opposing vertical support surfaces.

3. The adjustable keyboard support of claim 1, wherein the mounting plate includes two roller means for rolling within the first slot, and one roller means for rolling within the second slot.

4. The adjustable keyboard support of claim 1, wherein the inner end of the second bar is comprised of a roller and wherein the angled portion of the second slot includes concave detents formed along an edge thereof and sized to receive a portion of the roller for releasably holding the inner end of the second bar to releasably secure the shelf in a vertically displaced position.

5. The adjustable keyboard support of claim 3, wherein the inner end of the second bar includes a roller for displaceably rolling within the second slot, and wherein the mounting plate is provided with at least two rollers for displaceably rolling within the first slot.

6. The adjustable keyboard support of claim 2, wherein the opposing surfaces of the base include third slots, the third slots having teeth formed along lower inner edges thereof, the keyboard support further including an axle connecting respective third slots of the opposing surfaces of the base, the axle including opposing pinions for engaging with the teeth of the opposing third slots, the pinions being fixedly attached to said axle for rotation with said axle.

7. The adjustable keyboard support of claim 6, wherein the third slots are formed as inner recessed slots within the second slots.

8. The adjustable keyboard support of claim 6, wherein the third slots are formed between the first and second slots.

9. The adjustable keyboard support of claim 2, wherein the first slots each include teeth formed along an inner edge, the keyboard support further including an axle connecting the respective first slots of opposing surfaces of the base, the axle including opposing pinions for engaging the teeth of the respective first slots, the pinions being fixedly mounted to said axle for rotation with said axle.

10. The adjustable keyboard support of claim 1, wherein the first slots and bars respectively comprise upper slots and bars, and wherein the second slots and bars respectively comprise lower slots and bars.

11. The adjustable keyboard support of claim 1, wherein the first slots and bars respectively comprise lower slots and bars, and wherein the second slots and bars respectively comprise upper slots and bars.

12. The adjustable keyboard support of claim 1, wherein the outer angled portion angles downward from a horizontal portion of the second slot.

13. The adjustable keyboard support of claim 1, wherein the outer angled portion angles upward from a horizontal portion of the second slot.

14. The adjustable keyboard support of claim 1, wherein the outer angled portion angles first upward, then downward from a horizontal portion of the second slot.

15. The adjustable keyboard support of claim 1, wherein the base is mounted to the underside of a desk, the shelf being vertically raiseable while extended from the base.

16. The adjustable keyboard support of claim 1, wherein the base is mounted to the top of a desk, the shelf being vertically lowerable while extended from the base.

17. The adjustable keyboard support of claim 1, wherein the support includes a wrist rest positioned along a forward edge thereof.

18. The adjustable keyboard support of claim 17, wherein the shelf includes a closable tray formed along the forward edge, the wrist rest being formed along a hinged top surface of the tray.

19. An adjustable keyboard support, comprising:

a shelf for supporting a keyboard;

at least one support arm connecting the shelf to a vertical support surface in a base;

the support arm having first and second bars respectively connecting first and second points on the shelf to first and second horizontal slots in the support surface, with the second slot having an outer angled end portion;

the first and second bars having inner ends slidably and pivotally received in the first and second slots, respectively, the first and second bars having outer ends pivotally mounted to the shelf; and a mounting plate for connecting the inner end of the first bar to a pivot point on the second bar, the pivot point being intermediate the inner and outer ends of the second bar;

wherein the first bar has a shallow S-shape with a central portion being disposed at an angle to the second bar, and wherein a slidable tab is mounted to an upper edge of the second bar, the tab abutting a lower edge of the first bar at a selectable position along the central portion of the upper bar, with vertical displacement of the shelf being determined by the location of the tab along the upper bar.

20. An adjustable keyboard support comprising:

a shelf for supporting a keyboard;

a pair of support arms connecting the shelf to a vertical support surface in a base;

each of the support arms having upper and lower bars respectively connecting upper and lower points on the shelf to upper and lower horizontal slots in the support surface;

the upper and lower bars having inner ends slidably and pivotally received in the upper and lower slots, respectively, the upper and lower bars having outer ends pivotally mounted to the shelf;

the upper and lower bars being connected by a mounting plate, the mounting plate connecting the inner end of the upper bar to a pivot point on the lower bar, the pivot point being intermediate the inner and outer ends of the lower bar;

wherein the lower slot includes an upwardly-angled end portion, the shelf being vertically positionable by displacement of the inner end of the lower bar within the angled portion; and wherein the lower slot includes an inner recessed slot, the inner recessed slot having teeth formed along a lower inner edge thereof, the keyboard support further including an axle connecting respective recessed slots of the opposing surfaces of the base, the axle including opposing pinions for engaging with the teeth of the opposing inner slots, the pinions being fixedly mounted to the axle for rotation therewith.

* * * * *